US005337506A

United States Patent [19]

Klotz

[11] Patent Number: 5,337,506

[45] Date of Patent: Aug. 16, 1994

[54] SUB-BASE FOR TOP-MOUNTED GUNSIGHT

[76] Inventor: David A. Klotz, 364 Nichols Ave., Syracuse, N.Y. 13206

[21] Appl. No.: 751,546

[22] Filed: Aug. 29, 1991

[51] Int. Cl.[5] ..... F41G 1/387

[52] U.S. Cl. ..... 42/101; 33/247; 33/250

[58] Field of Search ..... 42/100, 101, 102, 103; 33/245, 247, 248, 249, 250

[56] References Cited

U.S. PATENT DOCUMENTS

| | | | |
|---|---|---|---|
| 1,710,547 | 4/1929 | Meise | 42/100 |
| 2,018,960 | 10/1935 | Kuhn | 42/100 |
| 2,119,925 | 6/1938 | Peterson | 33/245 |
| 2,200,869 | 5/1940 | Albree | 33/245 |
| 2,306,972 | 12/1942 | Meisel | 33/247 |
| 2,473,966 | 6/1949 | Olson . | |
| 2,556,903 | 6/1951 | Clark | 42/101 |
| 2,607,993 | 8/1952 | McKay . | |
| 2,767,473 | 10/1956 | Craven | 33/250 |
| 2,857,675 | 10/1958 | Kesselring . | |
| 3,491,975 | 1/1970 | Weaver | 42/101 |
| 3,835,565 | 9/1974 | Weast | 42/100 |
| 4,249,315 | 2/1981 | Hopson, III | 33/247 |
| 4,501,071 | 2/1985 | Manske | 33/245 |
| 4,707,772 | 11/1987 | Jimenez et al. | 33/241 |
| 4,776,126 | 12/1988 | Williams | 42/100 |
| 4,779,370 | 10/1988 | Cormack | 42/100 |
| 4,876,815 | 10/1989 | Terrill | 42/100 |
| 4,890,407 | 1/1990 | Nichols | 42/100 |
| 4,905,396 | 3/1990 | Bechtel | 42/101 |

OTHER PUBLICATIONS

B-Square Co., The American Rifleman, Sep. 1977, p. 57, "B-Square M94 Scope Mount".

*Primary Examiner*—Stephen M. Johnson
*Attorney, Agent, or Firm*—Morrison Law Firm

[57] ABSTRACT

A sub-base for a gun, such as a semiautomatic shotgun, that has a metal receiver. The sub-base of this invention permits a gunsight, such as a telescopic gunsight, to be removably mounted to the top of the gun's receiver with rigidity sufficient to remain in calibration permamently despite recoil. This substantial rigidity is obtained by fastening the sub-base to both sides of the receiver at their thickest parts and by angling the fasteners to maximize their holding power.

5 Claims, 1 Drawing Sheet

SUB-BASE FOR TOP-MOUNTED GUNSIGHT

BACKGROUND OF THE INVENTION

1. Field of the Invention

The present invention relates to the mounting of telescopic sights on guns, especially on semiautomatic shotguns. It is necessary for the telescopic sight to be rigidly mounted to the gun so that the line of sight is precisely parallel to the bore of the gun. Moreover, the sight's rigid mounting must withstand repeated heavy shocks from the recoil of the gun as it is fired. That is, the sight must be mounted so rigidly to the gun that the repeated heavy shocks do not generally affect the precise parallelism of the sight's tube and the gun's bore. Though occasional adjustment may be necessary, this parallelism must be maintained insofar as possible.

2. Prior Art

Most guns, especially semiautomatic shotguns, have a receiver made from metal that is substantially thinner at the top than at the sides. The top of the receiver is thus too thin to permit tapping and drilling for screws strong enough to hold the mounting for a conventional telescopic sight. On certain guns, e.g., Browning Model A-5, Remington Model 1100, and Remington Model 11-87, the receiver is so thin at the top that only two to two-and-a-half threads may be drilled therein. So few threads are insufficient to hold the mount for a telescopic sight to the gun with sufficient rigidity to withstand normal use. A sight mounted with screws held by only two to two-and-a-half threads will quickly work loose in response to the gun's recoil when it is fired. A loose sight or one that is not rigidly mounted will cause shots from that gun to be inaccurate. Indeed, when a telescopic sight is attached to the thin top of a conventional receiver on a semiautomatic shotgun, the recoil from a single shot can detach the sight, thereby endangering the shooter. Such an accident is likeliest when the gun's receiver is made of aluminum, which is a relatively soft metal.

Hence it is conventional for gunsmiths to mount a telescopic sight on such a gun by means of a side mount, such as a Weaver mount. Such a side mount is used because the side of the receiver on such a gun is sufficiently thick to hold the mount rigidly, having a thickness that supports approximately five threads. Unfortunately, however, mounting the sight on one side of the gun creates unnecessary bulk, in that a side mount projects from the gun at an angle of approximately 45 degrees from the vertical to clear the gun's receiver and then reverses to place the sight into vertical alignment with the gun's bore. A side-mounted sight is also difficult to align with the bore. Thus mounting a sight from one side only in the customary way can reduce both the comfort of the weapon and the accuracy of fire. Moreover, because a side mount is installed on one side of the receiver only, the sight it holds may work loose from the gun.

SUMMARY OF THE INVENTION

The principal object of the present invention is to permit the mounting of a telescopic sight on a gun in the most advantageous position, namely, on the top surface of the receiver.

Another object of the present invention is to provide a gun with a top-mounted telescopic sight that can withstand the repeated shocks of recoil without shifting out of alignment.

Still another object of the present invention is to mount a telescopic sight on a gun so that the sight and the gun will in general never move relative to each other, thereby keeping the sight always substantially in calibration relative to the gun's bore.

A further object of the present invention is to mount a telescopic sight on a gun so that it can be removed and reinstalled without changing the sight's calibration.

BRIEF DESCRIPTION OF THE DRAWINGS

The present invention is hereinafter described in more detail with reference to the accompanying drawings.

DESCRIPTION OF THE PREFERRED EMBODIMENT

Referring to FIGS. 1–4, sub-base 10 of my invention is constructed of Aluminum or other rigid metal of a thickness of approximately 0.125". It may be constructed by (1) cutting aluminum tubing of the proper diameter (approximately 1⅝" outside) lengthwise into three substantially equal pieces, each of said pieces being further shaped into a sub-base, (2) casting from molten metal by injection, (3) boring and milling from solid metal stock, or by any other method of working metal.

Figure 1:
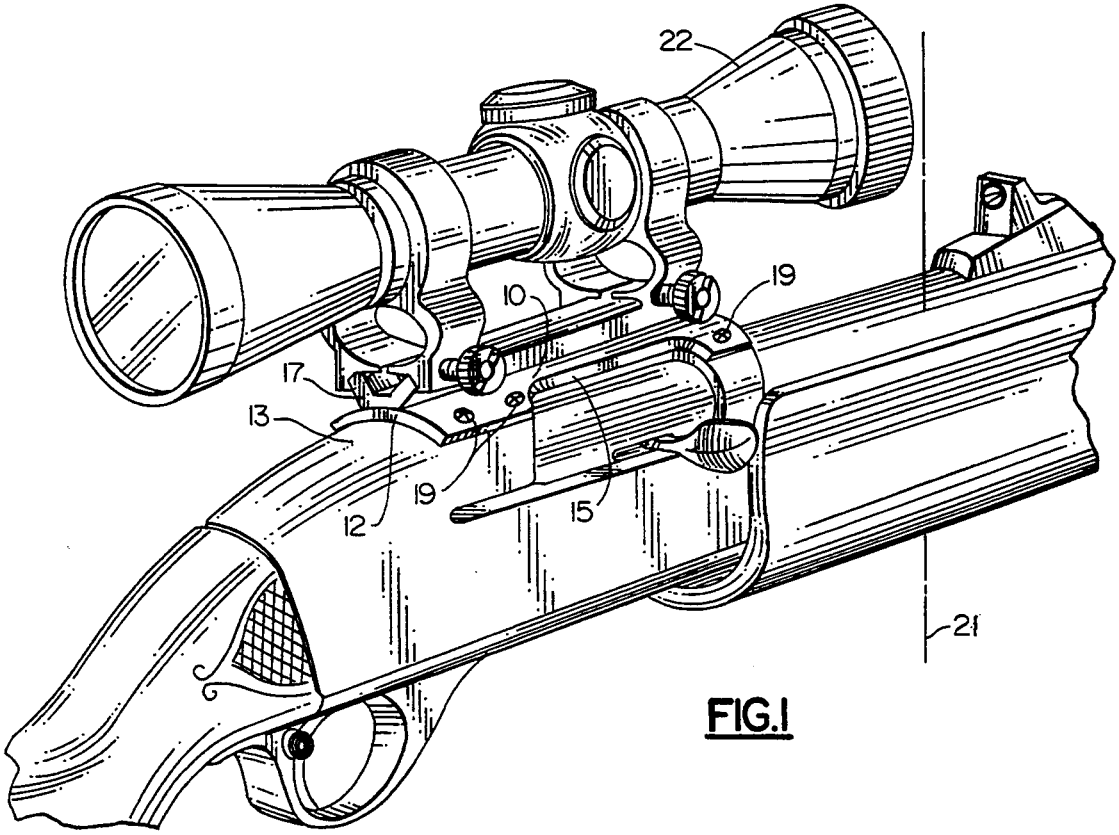
FIG. 1 shows in perspective the sub-base of my invention mounted upon a gun such as a semi-automatic shotgun.
Figure 2:
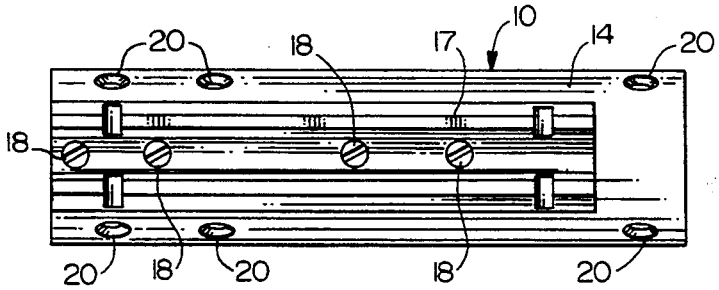
FIG. 2 shows the sub-base of my invention in plan view.
Figure 3:
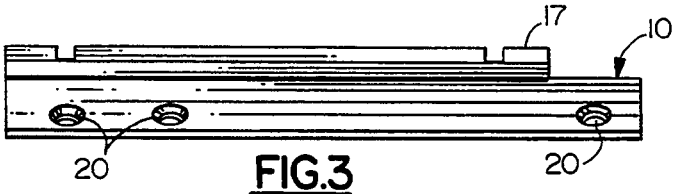
FIG. 3 shows the sub-base of my invention in side view.
Figure 5:
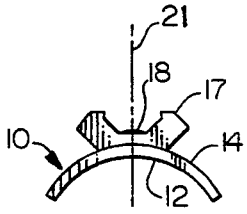
FIG. 5 shows the sub-base of my invention in cross-section.
Figure 4:
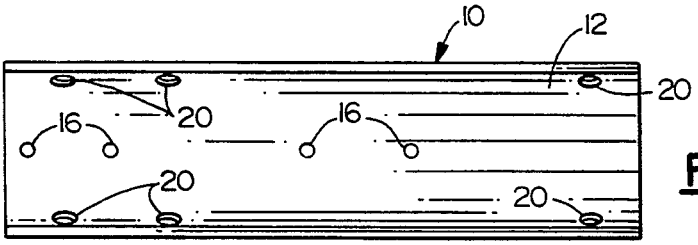
FIG. 4 shows the sub-base of my invention in bottom view.

Sub-base 10 of my invention is approximately 5 1/6 inches long and 1⅜ inches wide. As shown in FIG. 5, sub-base 10's cross-section is substantially in the shape of a 120-degree arc of a circle. Sub-base 10 is machined at bottom surface 12 to fit receiver 13 of the particular gun to which it is affixed. For mounting to those guns that require it, sub-base 10 may have port 15 cut out on the right or left side. Top surface 14 of sub-base 10 is drilled, and holes 16 are tapped to accept base 17 of a top, pivot, or see-through mount for a telescopic gunsight held in place by screws 18. A line 21 shows the vertical axis of the gun and sub-base 10.

Sub-base 10 of my invention is rigidly mounted to receiver 13 by means of a plurality of screws, approximately four to six (19). Screws 19 fit through holes 20 in sub-base 10 that are drilled through its sides at an angle substantially 45 degrees from the vertical. Screws 19 engage holes at a similar angle drilled into both sides of receiver 13 and tapped to a depth of approximately five (5) threads. Because sub-base 10 of my invention is rigidly held to both sides of receiver 13, sub-base 10 resists working loose under the repeated impact of recoil. Telescopic sight 22 mounted to sub-base 10 of my invention will therefore have its axis held precisely parallel to the gun's bore and remain in calibration for as long a time as possible.

The foregoing description of the preferred embodiments of the invention is presented for the purposes of illustration. It is not intended to exhaust the invention or to limit it to the precise forms disclosed, since many modifications are possible in the light of the above teaching. The scope of my invention should be limited not by this detailed description, but rather by the claims appended hereto.

I claim:

1. A method for mounting a telescopic gunsight on a semi-automatic shotgun including a receiver, which comprises:

attaching said gunsight to a base/sub-base element by means of dual rings having clamping means with attached clamp actuating means, said clamping means being clamped to said base;

forming said sub-base having a shape substantially conforming to said receiver;

attaching said base to said sub-base to form said base/sub-base element;

rigidly and permanently fastening said sub-base to a first and a second side of said receiver;

said step of fastening including bringing said sub-base substantially into contact with said receiver; and said step of fastening further including affixing a plurality of fasteners at an angle to a vertical axis of said shotgun.

2. In combination, a telescopic gunsight and a semi-automatic shotgun; comprising;

a receiver for said shotgun means for attaching said gunsight to said receiver; said means for attaching comprising dual rings having clamping means with attached clamp actuating means;

said clamping means being clamped to a base;

said base being attached to a sub-base;

said sub-base being rigidly and permanently fastened to said receiver by means of a plurality of fasteners; and said fasteners being affixed at an angle to a vertical axis of said shotgun.

3. The combination of claim 2, wherein said fasteners are a plurality of screws, said screws passing through a plurality of holes in said sub-base to engage a first side and a second side of said receiver.

4. The combination of claim 3, wherein said holes have axes at an angle of substantially forty-five degrees from the vertical axes.

5. The combination of claim 2, wherein a cross-section of said sub-base is substantially a 120-degree arc of a circle.

* * * * *